United States Patent [19]

Chung

[11] Patent Number: 5,003,643

[45] Date of Patent: Apr. 2, 1991

[54] FLUSH CONTROLLER FOR A TOILET BOWL

[76] Inventor: Wilson Chung, 5 fl., No. 126, Alley 69, Lane 285, Sec. 1, Nei Hu Road, Taipei, Taiwan

[21] Appl. No.: 436,231

[22] Filed: Nov. 14, 1989

[51] Int. Cl.[5] ..... E03D 1/00

[52] U.S. Cl. ..... 4/313; 4/304; 4/406

[58] Field of Search ..... 4/302, 304, 313, 406

[56] References Cited

U.S. PATENT DOCUMENTS

| | | | |
|---|---|---|---|
| 2,813,274 | 11/1957 | Lewis et al. | 4/313 |
| 3,575,640 | 4/1971 | Ishikawa | 4/313 X |
| 4,309,781 | 1/1982 | Lissau | 4/304 |
| 4,707,867 | 11/1987 | Kawabe et al. | 4/313 |
| 4,742,583 | 5/1988 | Yoshida et al. | 4/313 |
| 4,805,247 | 2/1989 | Laverty | 4/304 |

*Primary Examiner*—Charles E. Phillips

[57] ABSTRACT

A flush controller for a toilet bowl which can be readily added to the water reservoir of the currently used toilet bowl, includes a detecting device for detecting that a user has approached the toilet bowl to within a predetermined effective distance, that the user has remained within the predetermined effective distance for a first predetermined period of time, and that the user has left the predetermined effective distance. The flush controller also includes motor, having an output rotation shaft, a cap control coupled to the output rotation shaft of the motor for being driven by the motor, the cap control adapted to be connected to an outlet cap within the water reservoir of the toilet bowl, and a control device coupled to the detecting device and the motor, whereby when the detecting device detects that the user has approached the toilet bowl and remained within the predetermined effective distance for the first predetermined period of time, and that the user has left the predetermined effective distance thereafter, the control actuates the motor to rotate so as to drive the cap control to open-up the outlet cap, starting the water in the water reservoir to flush. The control then stops the motor for a second predetermined period of time to keep the water flushing. At the end of the second predetermined period of time the control re-actuates the motor to rotate so as to drive the cap control to close the outlet cap, stopping the water flushing. The control then stops the motor again, waiting for the next user.

3 Claims, 4 Drawing Sheets

FLUSH CONTROLLER FOR A TOILET BOWL

BACKGROUND OF THE INVENTION

The present invention relates to a flush controller for a toilet bowl, and more particularly, to a flush controller of a toilet bowl, and more particularly, to a flush controller of a toilet bowl which can detect the actual use of the toilet by a user and flush the toilet bowl automatically when the user finishes using it and leaves.

There are presently two kinds of flush control for toilet bowls: one is done by pressing a handle down once, and the water in the reservoir will flush wholly; the other is done by continuously keeping a handle pressed down, and the water will keep on flushing until the user releases the handle. Both of the aforementioned kinds of flush control require manual operation, which is very inconvenient, especially for the disabled. Furthermore, the handle may become the medium of infectious diseases since it is not decontaminated after being used.

SUMMARY OF THE INVENTION

In view of the foregoing, it is the object of the present invention to provide a flush controller for a toilet bowl which can flush automatically without any manual operation, which can be added onto the present toilet bowl easily and does not require a change in structure of the toilet bowl, and by which the flushing amount and time can be selectively set.

The flush controller for a toilet bowl, according to the present invention, comprises: a detecting means for detecting that a user has approached the toilet bowl to a predetermined effective distance, that the user has remained within the predetermined effective distance for a first predetermined period of time, and that the user has left the predetermined effect distance; a motor, having an output rotation shaft; a cap control means coupled to the output rotation shaft of the motor for being driven by the motor, with the cap control means adapted to be connected to an outlet cap within the water reservoir of the toilet bowl; and a control means coupled to the detecting means and the motor, whereby when the detecting means detects that the user has approached the toilet bowl and remained within the predetermined effective distance for the first predetermined period of time, and that the user has left beyond the predetermined effective distance thereafter, the control means actuates the motor to rotate so as to drive the cap control means to open-up the outlet cap, starting the water in the water reservoir to flush; the control means then stops the motor for a second predetermined period of time to keep the water flushing; at the end of the second predetermined period of time, the control means re-actuates the motor to rotate so as to drive the cap control means to close the outlet cap, stopping the water flushing; the control means than stops the motor again, waiting for the next user.

BRIEF DESCRIPTION OF THE DRAWINGS

The above and other objects, features and advantages of the present invention can be more clearly understood with reference to the following description of a preferred embodiment together with the accompanying drawing, wherein.

DETAILED DESCRIPTION OF THE PREFERRED EMBODIMENT

Figure 1:
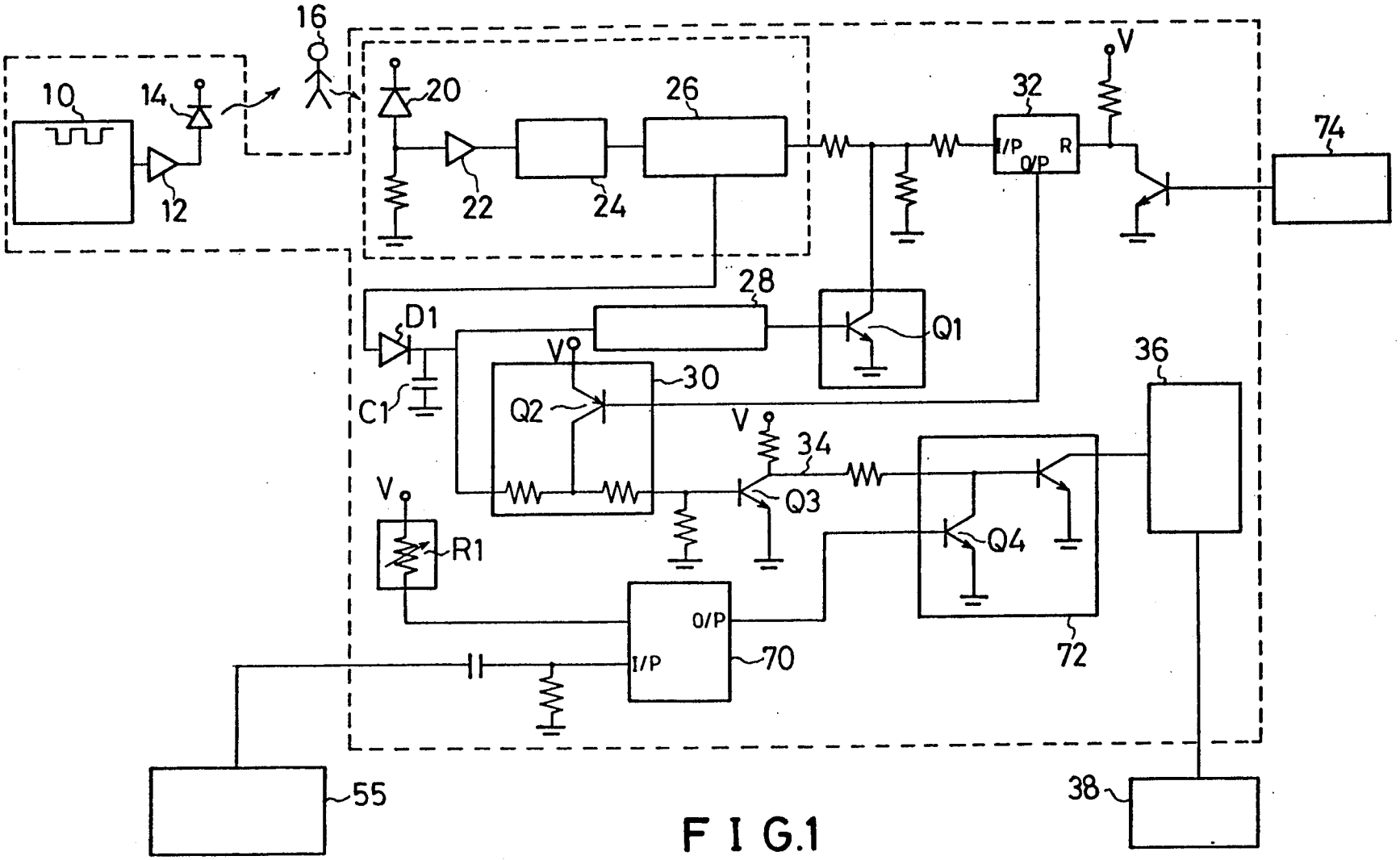
FIG. 1 shows the associated circuit diagram of the flush controller according to the present invention.

Referring to FIG. 1, the present invention is provided with an infrared generator 10 which generates infrared whereby the generated infrared signals are amplified by an amplifier 12 and transmitted by an infrared transmitter diode 14. When a human body 16 approaches the toilet bowl (not shown) to within a predetermined distance, for example 60–75 cm., the infrared signals will be reflected by the human body 16 and effectively received by an infrared receiver diode 20. The received infrared signals are amplified by an amplifier 22 and are in turn filtered by a filter 24 and rectified by a rectifier 26. The rectified signals are transmitted via a diode D1 and a capacitor C1 to a delay circuit 28 and a holding circuit 30, respectively. The delay circuit 28 will delay the signals for a predetermined time, for example 7 seconds, to ensure that there is a person using the toilet bowl and not just passing therethrough. After the delay time, the delay circuit will convert its output into low level to turn the transistor Q1 to OFF such that a timer 32 coupled to the rectifier 26 starts to receive the rectified signals: The timer 32 is thereby actuated and its output becomes high level, which makes a PNP transistor Q2 of the holding circuit 30 coupled to timer 32 to be OFF, and the timer starts counting. In the meantime, the voltage signals rectified by diode D1 and capacitor C1 take over the control of a transistor Q3 (which is ON at this moment).

When the user finishes and leaves, there will be no input signals. The timer 32 will be counting from its last input signal, and its output will remain HIGH. The PNP transistor Q2 of the holding circuit 30 will thus remain OFF. Since there is not rectified signal, the transistor Q3 becomes OFF, which makes the voltage on line 34 become HIGH and in turn makes a motor driver 36 actuate the motor 38.

Figure 2:
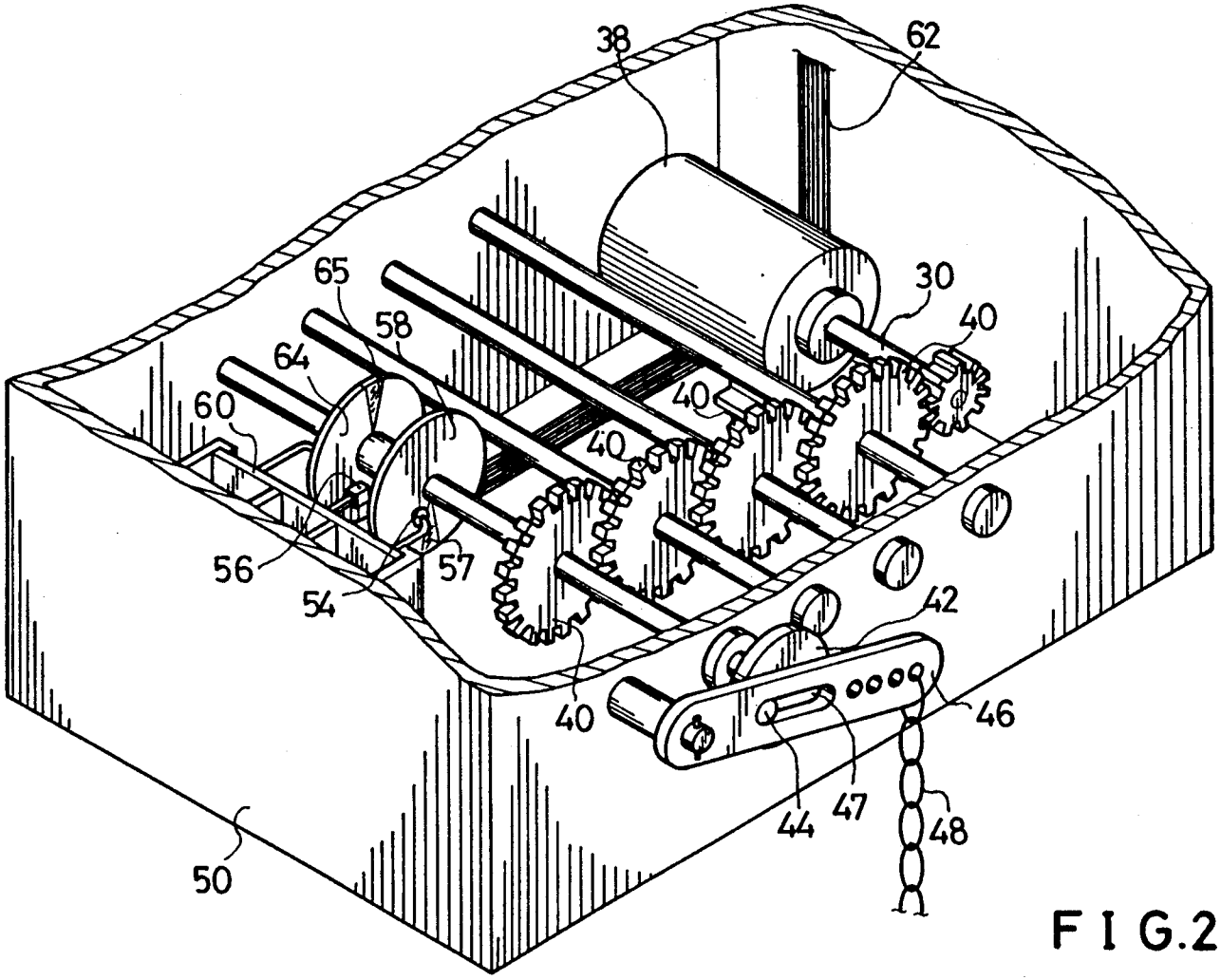
FIG. 2 shows the mechanical structure of the flush controller according to the present invention.
Figure 3:
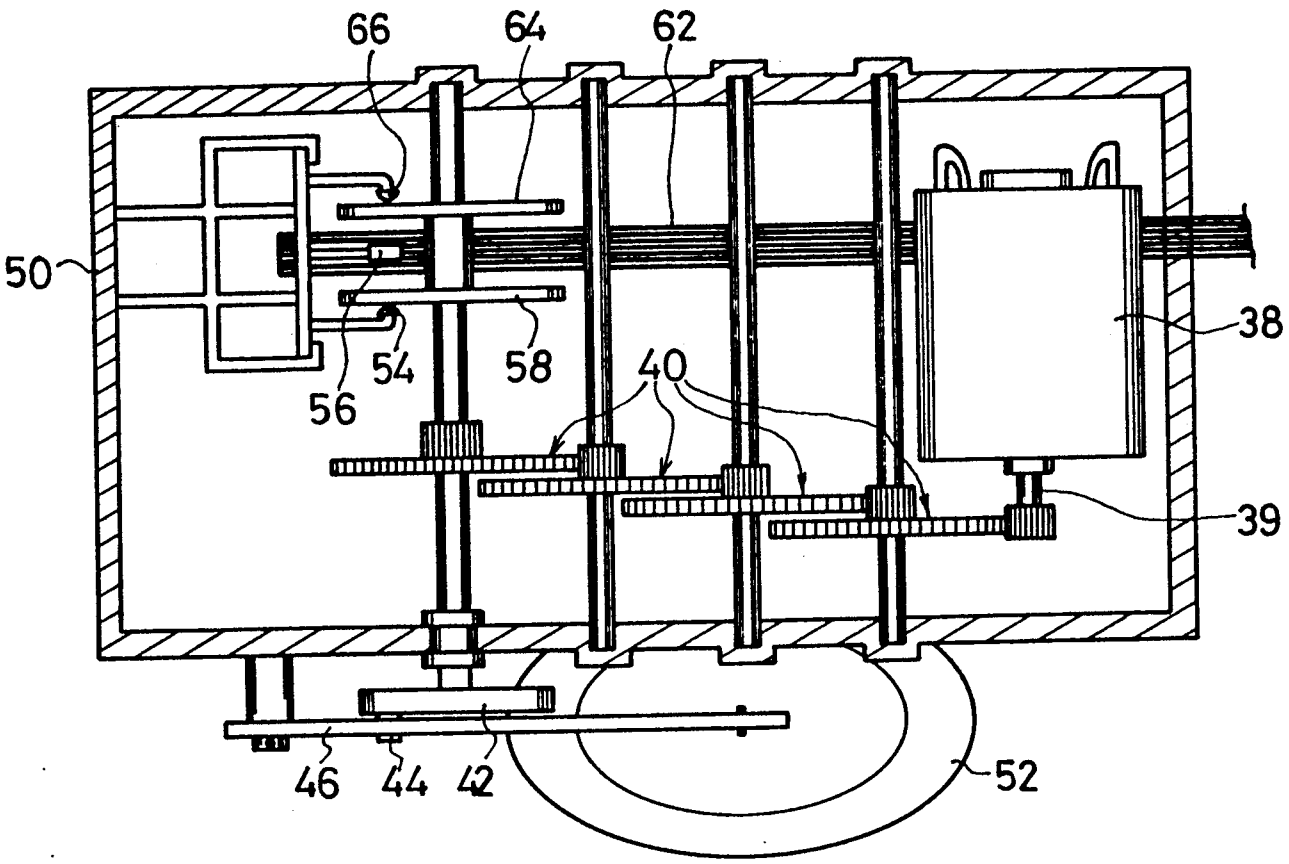
FIG. 3 shows the top view of FIG. 2.
Figure 4:
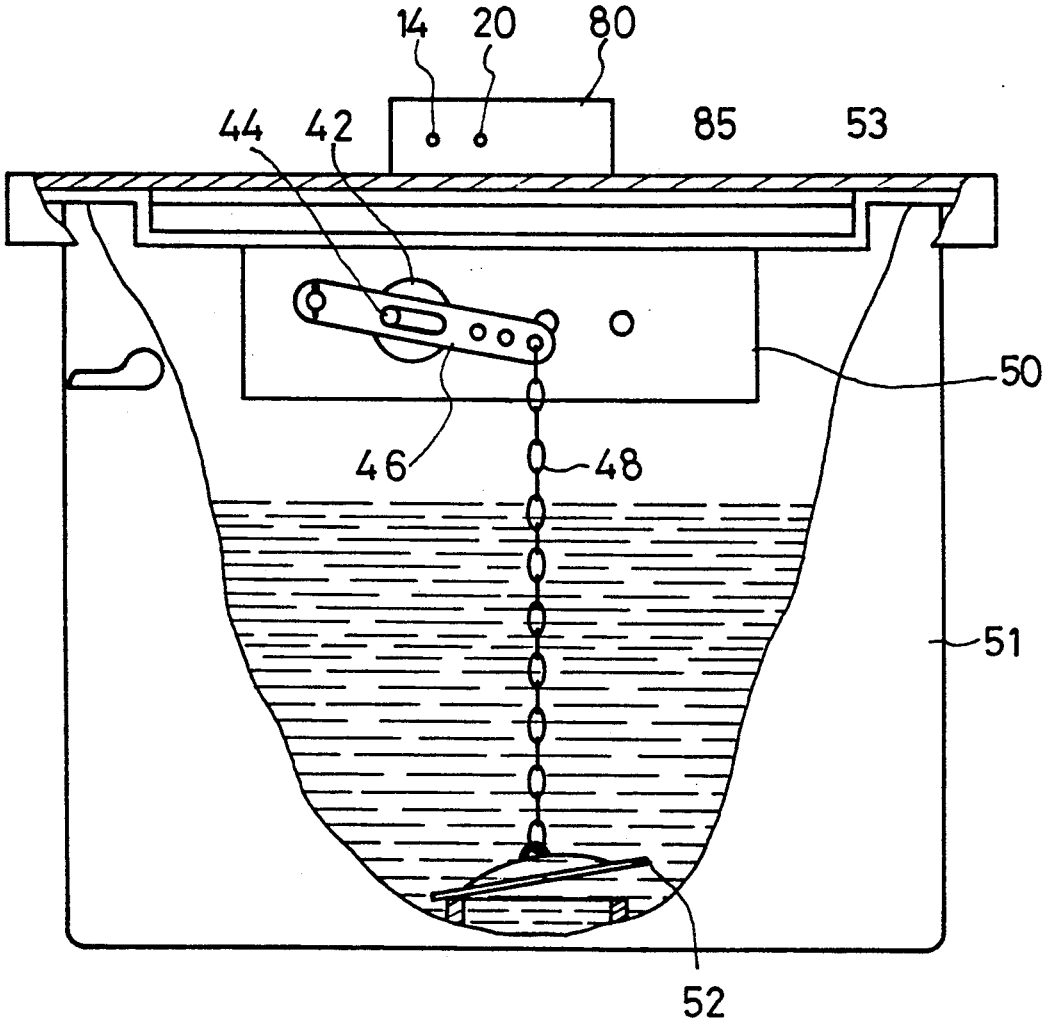
FIG. 4 shows schematically the embodied manner of the present invention when mounted onto the water reservoir of a toilet bowl.

Reference is now made to FIGS. 1 through 4. When the motor 38 rotates, the output shaft 39 will rotate a gear assembly 40 whose rotation will rotate a control wheel 42. An eccentric pin 44 is provided on the control wheel 42. The left end of a control lever 46 (FIGS. 2 and 3) is pivotally mounted on the housing of the control box 50 of the flush controller according to the present invention, whereas the right side of the lever 46 is connected to a cap 52 in the water reservoir 51 through a chain 48 (FIG. 4). A groove 47 is provided in the control lever 46 such that the eccentric pin 44 of the control wheel 42 can be inserted therein. When the control wheel rotates, the eccentric pin 44 will drive the lever 46 to pivotally move from its lowest position toward its highest position and open-up the cap 52 as shown in FIG. 4. The water hence flows out from the reservoir 51 and flushes the toilet bowl. There are provided a number of holes at the right side of the control lever 46 such that the user can selectively mount the chain in one of them to adjust the height of the cap 52 when it is opened-up, whereby the flushing amount of the water per unit time can be properly set.

The time when the control lever 46 reaches its highest position can be detected by a midway sensor 55

(FIG. 1), which includes a photosensitive diode 54, a light emitting diode 56 and a shielding wheel 58 (FIGS. 2 and 3). The photosensitive diode 54 and the light emitting diode 56 are welded on a circuit board 60 and are in turn coupled to the control circuit of the present invention via the wire-bank 62. The shielding wheel 58 and the control wheel 42 are fixed to the same rotation shaft and rotate synchronously. The shielding wheel 58 has a transparent window 57 (the other portion of the shielding wheel 58 is non-transparent), which is in alignment with the light emitting diode 56 and the photosensitive diode 54 when the eccentric pin 44 (and hence the lever 46) is at its highest position such that the photosensitive diode 54 can receive the light emitted by the light emitting diode 56 to sense that the control lever 46 has reached its highest position. The midway sensor 55 thereby triggers a timer 70 coupled therewith (FIG. 1). The output of the timer 70 becomes HIGH, which makes a transistor Q4 of a motor stop circuit 72 to be ON; the voltage on line 34 thus becomes LOW, and the motor driver 36 stops the motor 38 accordingly. At this moment, the cap 52 is still at its highest position and the water continues flushing. The timing of the timer 70 can be adjusted by a variable resistor R1. When the timer 70 times a predetermined period of time, for example 5 seconds, its output will become LOW. The transistor Q4 hence becomes OFF; the voltage on line 34 becomes HIGH; and the motor driver 36 starts to drive the motor 38 again. The control wheel 42 starts to pivotally move the control lever 46 from its highest position to its lowest position. Since the timing of the timer 70 can be adjusted, the flushing time and hence the flushing amount of the water can be adjusted. In another embodied form, an adjusting knob can be provided outside the water reservoir, allowing the user to adjust the flushing amount as is necessary so as to save water.

The predetermined timing period of the timer 32 is longer than that of the timer 70. Therefore the timer 32 is still counting even though the timer 70 has stopped counting. The output of the timer 32 is still kept HIGH, and hence the PNP transistor Q2 is still OFF; the transistor Q3 is OFF; and the voltage on line 34 remains HIGH.

When the control lever 46 pivotally moves to its lowest position, the cap 52 returns to a position sealing the water outlet, and the water stops flushing.

The time when the control lever 46 reaches its lowest position can be detected by an origin sensor 74 (FIG. 1), which includes a photosensitive diode 66, the light emitting diode 56 and a shielding wheel 64 (FIGS. 2 and 3). The photosensitive diode 66 is also welded on the circuit board 60 and in turn coupled to the control circuit of the present invention via the wire-bank 62. The shielding wheel 64 is also fixed to the same rotation shaft of the control wheel 42 and can rotate synchronously with the control wheel 42. The shielding wheel 64 has a transparent window 65, which is 180 degrees opposed to the transparent window 57 of the shielding wheel 58. When the eccentric pin 44, and thus the control lever 46, is at its lowest position, the transparent window 65 is in alignment with the light emitting diode 56 and the photosensitive diode 66 such that the photosensitive diode 66 can receive the light emitted by the light emitting diode 56 to sense that the cap has sealed the water outlet of the reservoir 51. The origin sensor 74 then resets the timer 32 coupled therewith (FIG. 1) to make the output of the timer 32 become LOW. The PNP transistor Q2 returns to its ON position to make the voltage at the base of the transistor Q3 become high level, and the transistor Q3 is thereby ON. The voltage on line 34 thus becomes LOW again to stop and disable the motor 38, waiting for the next user.

Reference is now made to FIG. 4, in which the portions of the structure of the reservoir 51 that do not relate to the present invention are omitted. The control mechanism according to the invention is placed in the control box 50, on which a positioning frame 85 is provided such that it can be positioned on the peripheral edges of the reservoir 51, and the cover 53 of the reservoir can be put thereon. The control circuit of the invention is placed in a control box 80 which may be positioned directly upon the cover 53 of the reservoir. In accordance with the present embodiment, the electrical connection between the control boxes 50 and 80 is achieved by a wire-bank 62, which has a flat configuration such that is is adapted to be connected to the control box 80 from inside the reservoir. Thus, the user can add the present invention into the toilet bowl conveniently without changing the current structure.

The above described embodiment achieves the human detection by means of the infrared element. However, it should be obvious to those skilled in this art that other suitable techniques can also be applied to this invention instead of the infrared to detect the presence of a person using the toilet.

While the present inveniton has been described in accordance with a preferred embodiment, it should be noted that the description is for illustration and should not be interpreted as for definition. Various modifications are possible to those skilled in this art without departing from the spirit and true scope of this invention, and thus they should be deemed as included in the following claims.

What is claimed is:

1. A flush controller for a toilet bowl, said toilet bowl including a water reservoir having an outlet cap, said flush controller comprising:

detecting means for detecting that a user has approached said toilet bowl to within a predetermined effective distance, that said user has remained within said predetermined effective distance for a first predetermined period of time, and that said user has left said predetermined effective distance;

a motor, having an output rotation shaft;

cap control means coupled to said output rotation shaft of said motor for being driven by said motor, said cap control means adapted to be connected to said outlet cap of said water reservoir; and a control means coupled to said detecting means and said motor wherein said cap control means includes:

a gear assembly engaged with said output rotation shaft of said motor to be driven by said motor;

a control wheel connected with said gear assembly for rotation by the driving of said gear assembly, said control wheel having an eccentric pin; and a control lever of which one end is pivotally connected to said flush controller and the other end is adapted to be connected to said outlet cap of said water reservoir, said control lever having a strip-shaped groove in which said eccentric pin of said control wheel is inserted such that the rotation of said control wheel can move said control lever pivotally between a highest position and a lowest position;

wherein said control means includes:

an original sensor for detecting that said control lever is at its lowest position; and a midway sensor for detecting that said control lever is at its highest position;

whereby when said detecting means detects that said user has approached said toilet bowl and remained within said predetermined effective distance for said first predetermined period of time, and that said user has left said predetermined effective distance thereafter, said control means actuates said motor to rotate which in turn drives said gear assembly and said control wheel to rotate, moving said control lever pivotally from its lowest position to its highest position so as to open-up said outlet cap, starting the water in said water reservoir to flush; when said midway sensor detects that said lever is at its highest position, said control means stops said motor for a second predetermined period of time to perpetuate the water flushing; at the end of said second predetermined period of time said control means re-actuates said motor to rotate, which in turn drives said gear assembly and said control wheel to rotate again, moving said control lever pivotally from its highest position to its lowest position so as to close said outlet cap, stopping the water flushing; when said origin sensor detects that said control lever is at its lowest position, said control means then stops said motor again, waiting for the next user.

2. The flush controller according to claim 1, wherein said predetermined distance is within the range of 60–75 cm.

3. The flush controller according to claim 1, wherein said detecting means includes an infrared sensor.

* * * * *